US005970867A

United States Patent [19]

Barozzi

[11] Patent Number: 5,970,867

[45] Date of Patent: Oct. 26, 1999

[54] MACHINE FOR THE SILK-SCREEN PRINTING OF SHEETS, EQUIPPED WITH APPARATUS FOR ADJUSTING THE RELATIVE POSITION OF THE SHEET AND THE PRINTING SCREEN

[75] Inventor: Gian Piero Barozzi, Crema, Italy

[73] Assignee: Aisa S.P.A., Ticengo, Italy

[21] Appl. No.: 08/897,922

[22] Filed: Jul. 21, 1997

[30] Foreign Application Priority Data

Jul. 26, 1996 [IT] Italy ..... MI96A1599

[51] Int. Cl.[6] ..... B41F 15/26

[52] U.S. Cl. ..... 101/126; 101/DIG. 36; 101/474; 33/614

[58] Field of Search ..... 101/126, 114, 101/123, DIG. 36, 474; 33/614, 615, 623, 613, 407.1

[56] References Cited

U.S. PATENT DOCUMENTS

| | | | |
|---|---|---|---|
| 4,040,352 | 8/1977 | Curti | 101/126 |
| 4,246,866 | 1/1981 | Hopings et al. | 118/213 |
| 4,389,936 | 6/1983 | Jaffa et al. | 101/123 |
| 4,805,316 | 2/1989 | Curti | 33/613 |
| 5,367,953 | 11/1994 | Yamashita et al. | 101/DIG. 36 |

*Primary Examiner*—Christopher A. Bennett
*Attorney, Agent, or Firm*—Herbert Dubno

[57] ABSTRACT

Machine for the silk-screen printing of flat articles such as sheets of glass (2) and the like, comprising at least four fixed uprights (10) supporting horizontal parallel beams (20) on which a bridge (30) carrying the printing means (40) is movable, and a surface (3) for resting the glass (2), said machine comprising an apparatus (100; 1000) for gripping and centring the glass (2) with respect to the fixed printing screen (4).

12 Claims, 5 Drawing Sheets

600
602
105a
103a
201
601
102b
1000
2
101
102b
101a
3
103a
500
510
501

105
602
103a
101a
201
3
302
302a
102b
3a
601
2
101
101a
102b
502b
513a
515b
514
520a
502
520
103a
501
517a
515a
517
510
513
511b

MACHINE FOR THE SILK-SCREEN PRINTING OF SHEETS, EQUIPPED WITH APPARATUS FOR ADJUSTING THE RELATIVE POSITION OF THE SHEET AND THE PRINTING SCREEN

SPECIFICATION

1. Field of the Invention

The present invention relates to a machine for the silk-screen printing of substantially flat sheets such as sheets of glass, panels and the like, equipped with an apparatus for the automatic adjustment of the relative position of the sheet being processed with respect to the fixed printing screen.

2. Background of the Invention

It is known, in particular in the glass industry, of the need to print decorations and the like onto flat sheets such as sheets of glass and the like, by means of the silk-screen printing technique by silk-screen printing machines. Such machines are provided with devices for adjusting the position of the printing frame relative to the surface of the glass, both in directions lying in a plane parallel to the glass itself and in a vertical direction perpendicular to the plane of the glass. In the vertical direction the so-called "off contact" distance of the printing screen from the glass itself is determined. In order to avoid printing smudges which would occur if the screen were in contact with the glass.

An example of such machines is described in the patent application IT-94A 2203.

The machines of the known type, however, have some drawbacks including the need of having to perform relative centering of the sheet on which silk-screen printing is to be performed and the printing frame by means of manual adjustments of the position of the frame with respect to the sheet kept locked in a suitably predefined position.

This type of centring requires, that the entire printing frame be displaced in order to be able to perform the adjustments, thus causing considerable difficulties during execution and measurement errors mainly due to the inevitable play which forms between the various parts of the frame.

OBJECTS OF THE INVENTION

It is therefore a principal object of the invention to provide a machine for the silk-screen printing of flat articles which allows rapid and precise relative centering of sheets with an asymmetrical profile.

Still, a further object is to provide the machine which comprises centering means allowing the operation to be performed both in a totally automatic manner and in a semi-automatic manner.

SUMMARY OF THE INVENTION

These results are obtained by the inventive machine for the silk-screen printing of flat articles such as sheets of glass and the like, equipped with the apparatus for the automatic adjustment of the relative position of the sheet being processed with respect to the fixed printing screen.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
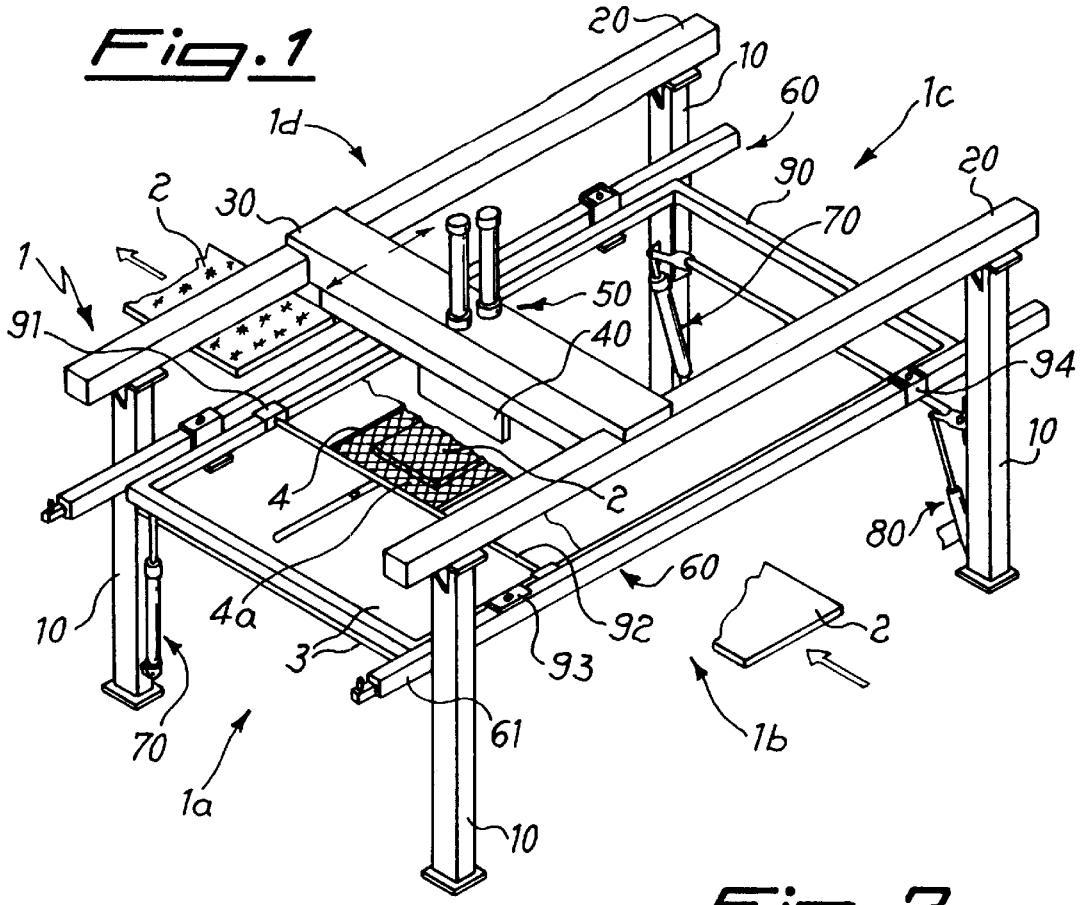
FIG. 1 is a schematic axonometric view of the machine according to the invention.
Figure 2:
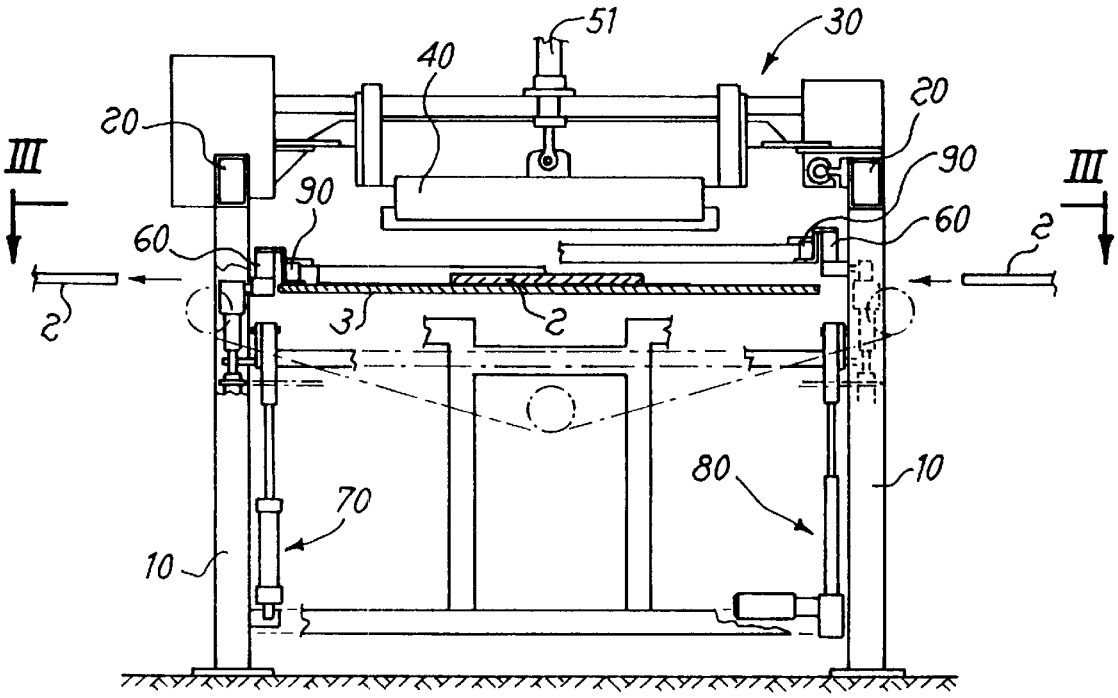
FIG. 2 is a front view from the front side of the machine according to FIG. 1.

As shown in FIG. 1, the machine 1 according to the invention is composed of four uprights 10 supporting two fixed beams 20 fastened to the top ends of the uprights 10. The beams have mounted on them slidably in the longitudinal direction a bridge 30 which has fixed to it the support carrying the doctor blade 40, the squeegee and associated means 50 for operation thereof in a direction perpendicular to the plane of the glass 2. The orientation of the machine is such that there is a front side 1*a* where the operator stands, a side 1*b* for the supplying of the glass sheets 2, a rear side 1*c*, and a side 1*d* for unloading the glass.

The uprights 10 also have connected to them two longitudinal guides 60 which can be operated so as to move in a substantially vertical direction with respect to the underlying surface 3 supporting the glass 2 by means of associated actuating devices 70 and 80.

The guides 60 have fixed to them the counter-frame 90 which carries the frame 4 of the printing screen 4*a*.

The frame 4 supporting the screen 4*a* is fixed to the counter-frame 90 by means of cross-pieces 92 sliding by means of supports 91 on the counter-frame itself, which is in turn fastened to the guides 60 by means of holes in the counter-frame 90 inside which corresponding pins of means 160 for adjusting the position of the counter-frame, fixed to the cross-pieces 92 (FIG. 3), are accommodated.

The adjusting means 160 act so as to position the counter-frame 90, and hence the frame 4, in the different directions of the horizontal plane and with respect to the predetermined zero position of the machine.

The bridge 30 (FIG. 1) carries the group 50 for moving the support 40 carrying the doctor blade and the squeegee. The moving group substantially consists of a pair of cylinders arranged behind on another in the longitudinal direction of the machine and respectively connected to the printing doctor blade and to the spreading squeegee.

Operation of the machine is as follows: once the printing screen 4 has been prepared. It is mounted on the counter-frame 90 by sliding the cross-pieces 92 by the required amount and locking them in position; then the counter-frame 90 is mounted on the guides 60 on which it rests by means of rectangular blocks 93.

At this point, by operating the handwheels 160, adjustment of the counter-frame 90 with respect to the horizontal surface 3 supporting the glass 2 is performed, obtaining definitive positioning of the counter-frame and hence the screen 4*a*.

The lugs 93 are finally fixed, via known means, to the guides 60, thus making the counter-frame 90 perfectly integral with the guides.

Figure 3:
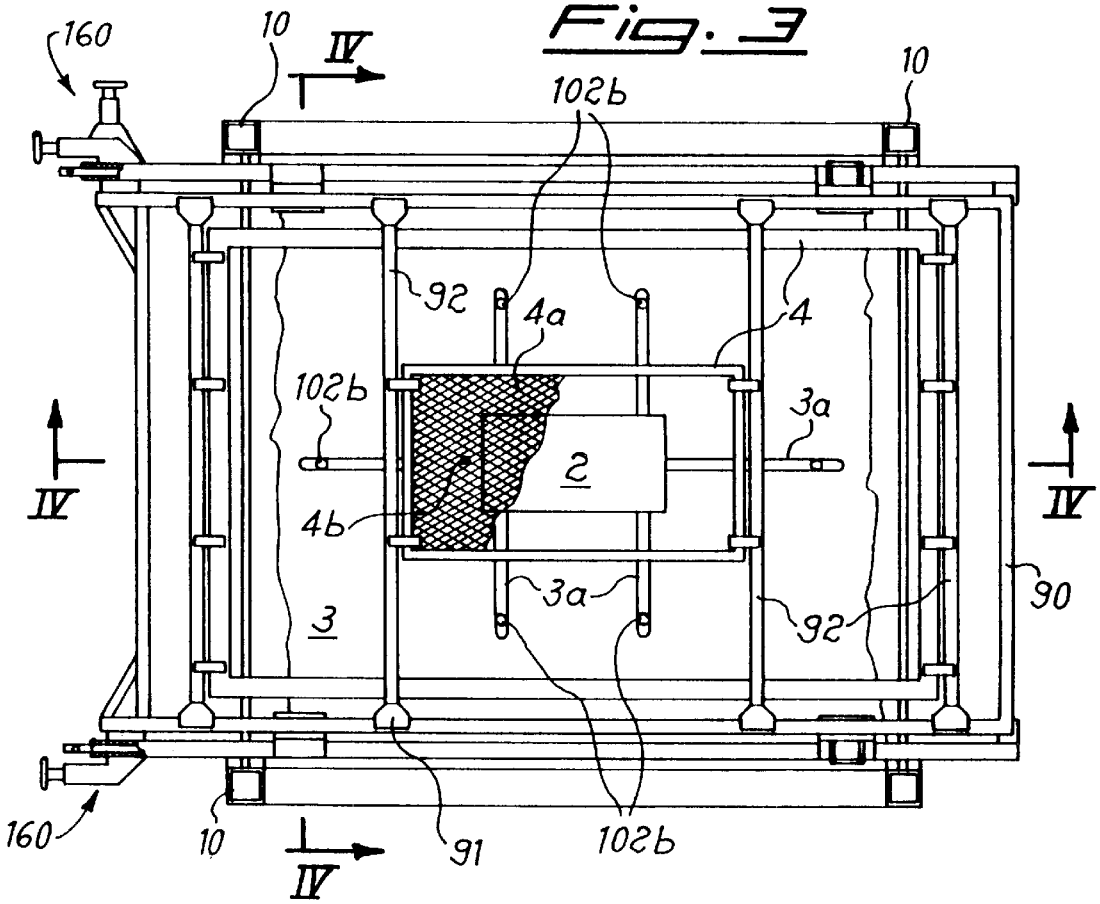
FIG. 3 is a schematic view of the machine along the plane indicated by III—III in FIG. 2.
Figure 8A:
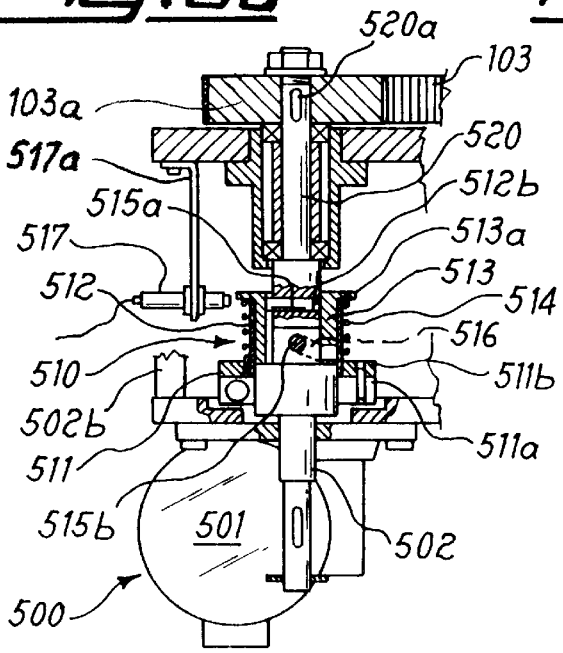
FIGS. 8*a*, 8*b* are a schematic vertical section of the torque-limiting coupling for locking the glass respectively in the positions with the rollers open and the rollers closed.
Figure 8B:
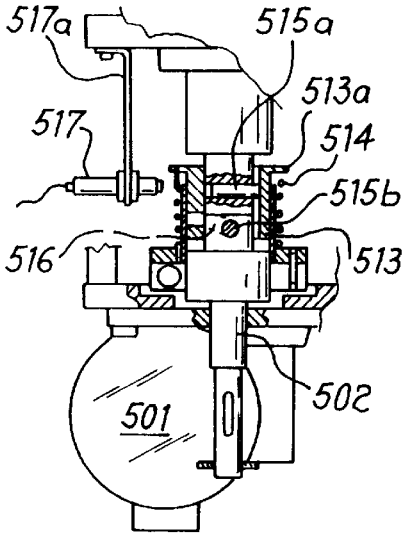

FIG. 3 shows the working surface 3 has formed in it at least three slits 3*a* arranged in longitudinal and horizontal directions of the machine. More particularly, the example in the FIG. 3 shows two slits parallel to the transverse direction and one slit parallel to the longitudinal direction. It is obvious, however, that it is possible to provide any combination of the positions of the said slits in relation to the specific requirements.

Figure 4:
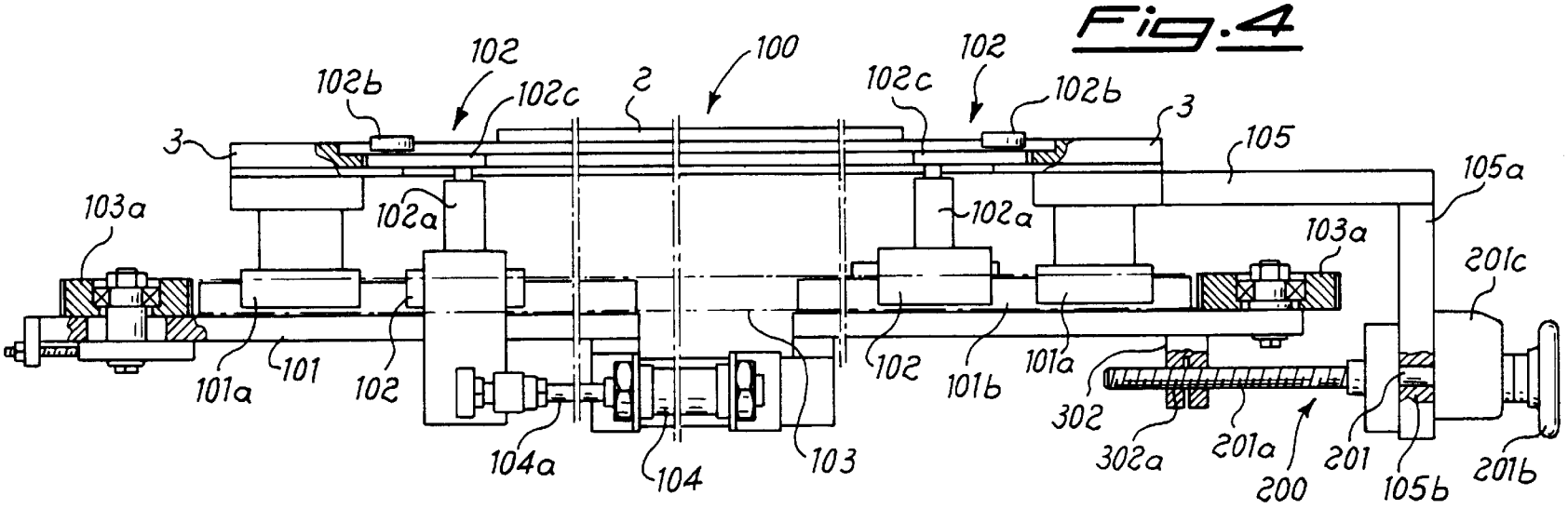
FIG. 4 is a schematic section along the plane indicated by IV—IV in FIG. 3 of the device for locking and centring in the manual adjustment version.
Figure 5:
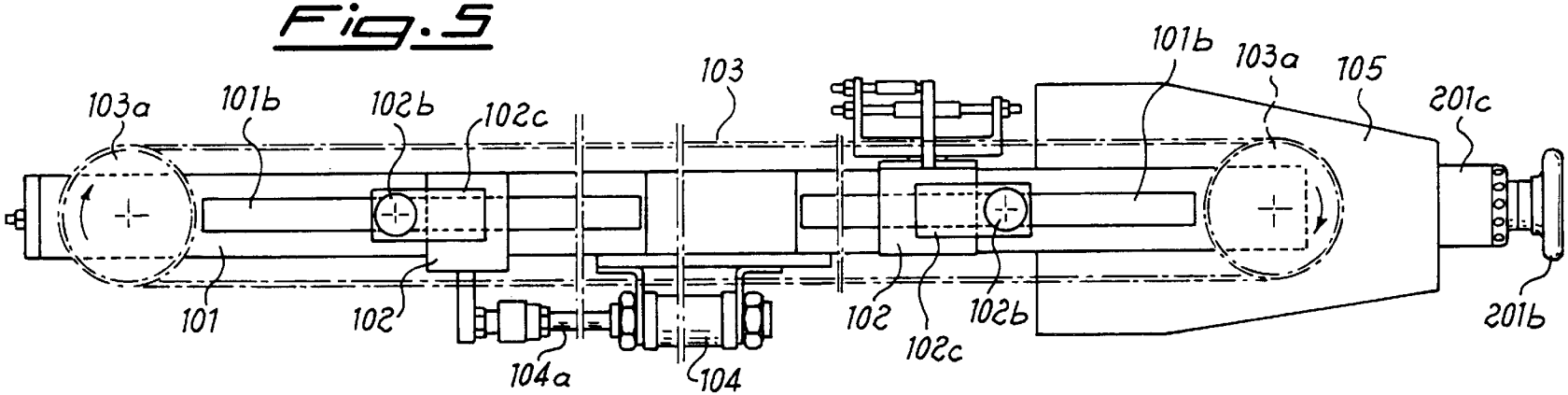
FIG. 5 is a plan view of the movable guides of the centring device according to FIG. 4.

As can be seen in FIGS. 4 and 5, each slit 3*a* in the surface 3 has associated with it a device 100 for centring the glass 2 with respect to the printing screen 4*a*. The device comprises at least one support 101 fixed in the vertical direction to the surface 3 on which the glass 2 rests, by means of associated means arranged in the vicinity of the opposite ends of the guide itself and comprising a sliding shoe 101*a*, substantially in the form of an upturned U, suitable for allowing relative sliding, in the longitudinal direction, of the support 101 with respect to the fixed surface 3, as will be explained more clearly below.

The upper surface of the support 101 has formed in it two longitudinal guides 101*b* arranged symmetrically with respect to the line of transverse symmetry of the support 101.

Each longitudinal guide 101*b* has housed inside it a sliding carriage unit 102 on which there is fixed a vertical flange 102*a*, the upper free end of which has mounted on it a roller 102*b* idle on a vertical axis. particularly, the roller is supported by a horizontal support 102*c* extending towards the outside so as to allow a greater travel in relation to the dimensions of the glass 2, as will be explained more clearly below.

Each carriage unit 102 is also attached on opposite sides to a toothed belt 103 forming an endless loop on two idle pulleys 103*a* arranged at the opposite ends of the support 101.

One of the two carriage units 102 is moreover fastened to the free end of the rod 104*a* of a pneumatic cylinder 104, the travel of which causes movement of the toothed belt 103 in both directions and therefore the symmetrical movement towards one another or away from one another of the two carriage units 102 and hence the rollers 102*b* projecting on the working surface. More particularly the outward movement of the rod 104*a* causes movement of the carriage units 102 away from each other towards the end of the guide 101, while the inward movement of the rod causes a relative approaching movement of the carriage units towards the centre of the guide 101.

The cylinder, if suitably calibrated, determines the closing force on the glass and retention thereof during the various operations.

As shown in FIG. 4, the fixed working surface 3 also has secured to it a flange 105, substantially in the form of an upturned L, on the vertical side 105*a* of which are mounted the means 200 for adjusting the relative longitudinal position of the support 101 and the fixed working surface 3.

Said adjusting means 200 substantially consist of a horizontal screw 201 passing through a hole 105*b* in the side 105*a* of the L-shaped flange 105, the threading 201*a* of the screw 201 being designed to engage with a female thread 302*a* of a projection 302 fixed to the support 101. The head of the screw comprises an operating handwheel 201*b* which acts on a stop piece comprising a digital counter 201*c* which displays the measurement of the displacement performed by the screw 201.

With this configuration, the rotation of the handwheel in either direction causes sliding, in the longitudinal direction, of the support 101 on the sliding shoe 101*a* in the form of an upturned U integral with the fixed surface 3.

Operation of the machine in the configuration for manual adjustment described above is as follows:

Once the silk-screen printing machine has been prepared and the printing screen 4 positioned in its seat (FIGS. 1 and 3) on the counter-frame 90 and the latter positioned on the guides 60 in a fixed position on a plane parallel to the glass 2 and then locked to the guides 60 themselves via known means associated with the lugs 93, the sheet of glass 2 is supplied (by means of associated devices not shown), arranging it on the working surface 3 in an approximately centred position.

At this point, sensors, not illustrated, cause activation of the devices 100 for centring the glass 2 with respect to the printing screen 4*a*: more particularly (FIG. 4) the cylinders 104 associated with each support 101 are actuated so as to cause retraction of the rod 104*a* inwards; the travel of the rod 104*a* causes movement, in an anti-clockwise direction, of the toothed belt 103, the rotation of which about the pulleys 103*a* causes the symmetrical movement towards one another of the carriage units 102 which, by means of the horizontal support 102*c*, transport the rollers 102*b* towards the sheet 2 arranged on the working surface 3, until they come into contact with the edges of the sheet, resulting in stable holding thereof.

Figure 9A:
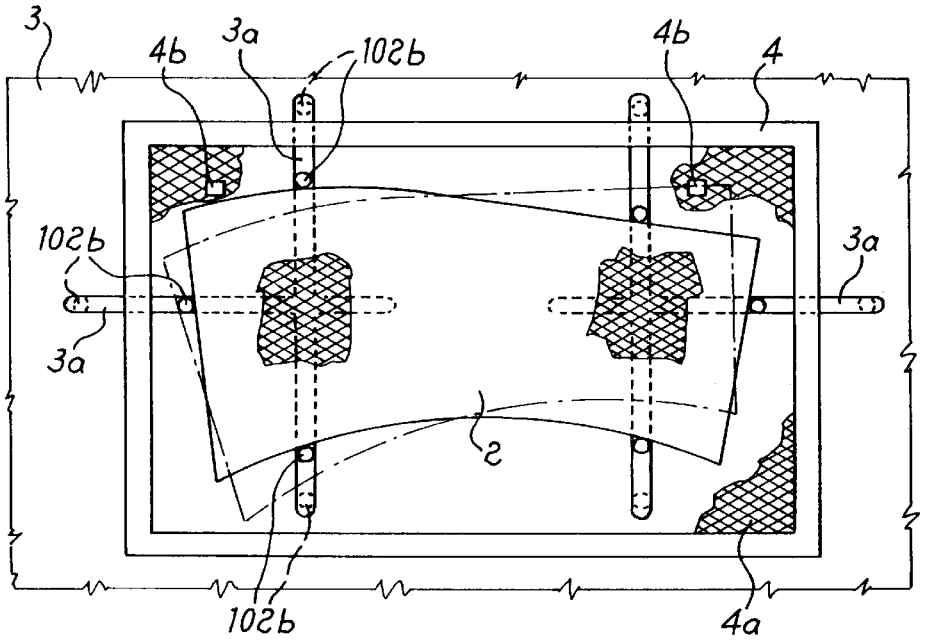
FIGS. 9*a*, 9*b* are a schematic view of the means for automatic centring of the glass with respect to the frame.
Figure 9B:
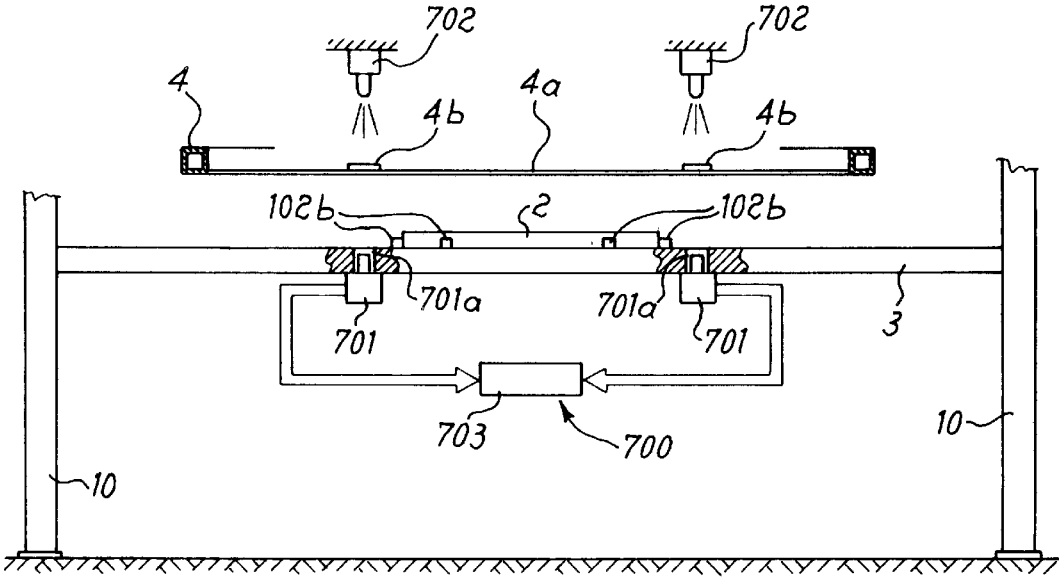

The symmetrical closure of the rollers 102*b* against the sides of the sheet 2 causes stable gripping thereof by the rollers and displacement of the sheet towards the centre position of the machine. During this stage the glass 2 is therefore kept integral with the devices 100 and centred with respect to the machine, but not with respect to the screen 4*a*. It is therefore necessary to centre the glass 2 with respect to some printing reference points 4*b* present on the screen 4*a* itself (FIG. 9*a*).

In order to obtain this centering action, the operating handwheels 201*b* of each support 101 are operated so that, by means of the screw 201, they cause the translation of the respective support 101, and hence the sheet 2 integral therewith, by means of the rollers 102*b*. It is possible thus to center the glass 2 with respect to reference points of the printing screen 4*a*, moving with micrometric precision the glass with respect to the printing frame rather than vice versa.

The handwheels 201*b* operating the screws 201 may also have associated with them an instrument for digital measurement 201*c* suitable for displaying the relative displacement of the support 101 and allowing recording of the measurements so as to be able to print identical batches of glass sheets also in different time periods, reducing to a minimum the idle time for preparation of the machine.

With reference to FIGS. 6 to 9*b*, a second, totally automated embodiment 1000 of the device for centering the glass 2 is now described.

Figure 6:
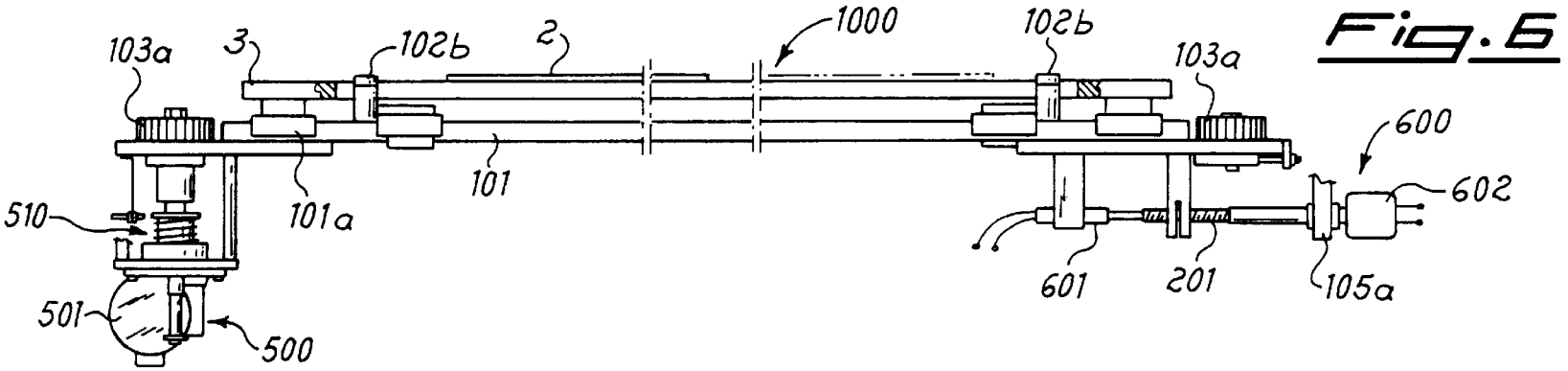
FIG. 6 is a section along the plane indicated by IV—IV in FIG. 3 of the device for locking and centring the glass in the automatic adjustment version.
Figure 7:
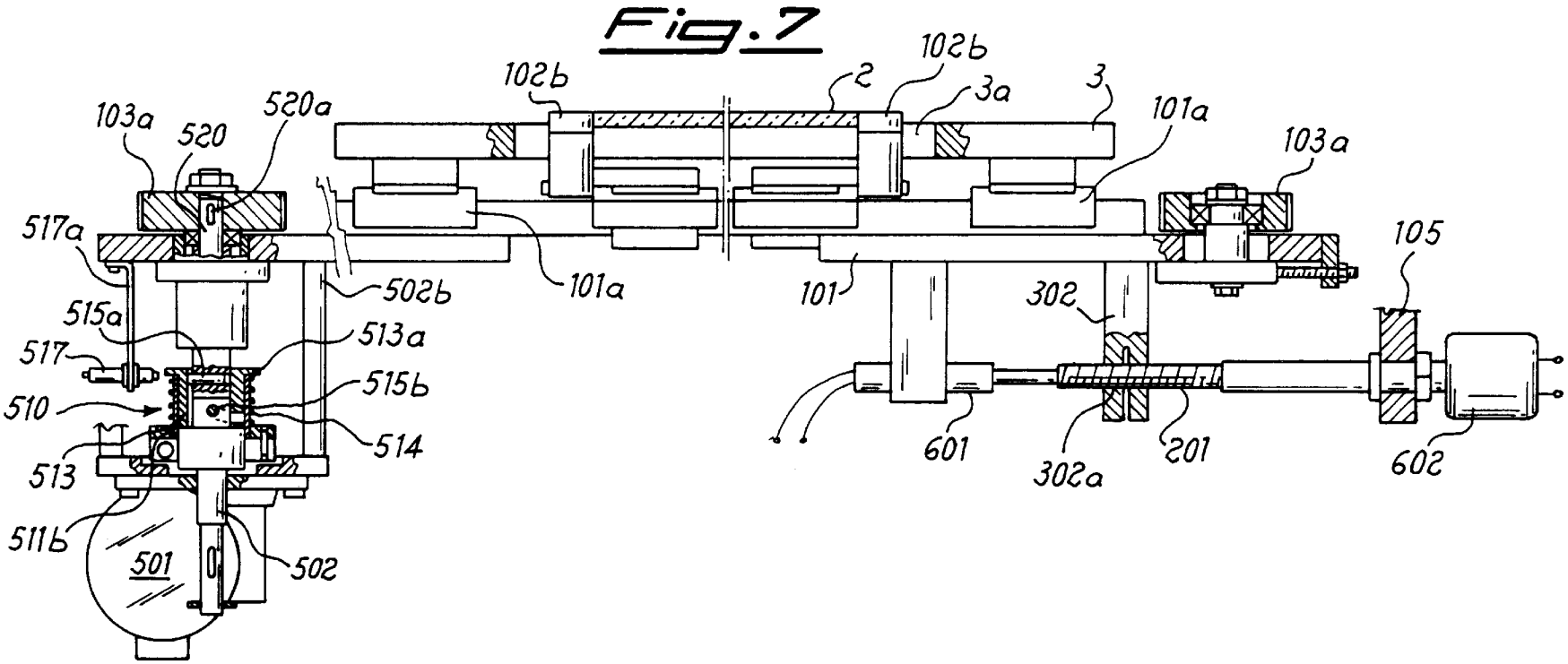
FIG. 7 is an enlarged view of the end parts of the section according to FIG. 6.

As illustrated in FIGS. 6 and 7, the apparatus 1000 for centering, with automatic adjustment, the glass 2 with respect to the printing screen 4*a* retains the same basic components of the version for manual adjustment, namely: the support 101, the carriage units 102 carrying the rollers

102*b* gripping the glass 2, the screws 201 for translation of the supports 101, with which there are associated devices 500 for automatic control and operation of the toothed belt 103, devices 600 for operation and control of the screw 201, devices 700 (FIG. 9*b*) for detecting the relative position of the screen 4*a* and for controlling and operating the actuating devices 600.

More particularly, one of the two pulleys 103*a* supporting the toothed belt 103 is driven by means of a gearmotor 501 operating a drive shaft 502 coaxial with the pulley 103*a* which is coaxially constrained, by means of a tongue 520*a*, with a driven shaft 520. The gearmotor is fixed to the support 101 by means of associated connecting elements 502*b*.

Between the drive shafts 502 and the driven shaft 520 there is arranged a torque-limiting coupling 510 comprising a base 511 which is fixed to the shaft 502 of the gearmotor and retained by a clamp 511*a* and by a washer 511*b* which are connected together.

Coaxially with the base 511 there is arranged a safety spacer 512 which has keyed inside it a bush 513, the upper edge of which has a circular lip 513*a* to which a first end of a torsion spring 514 is fixed, the other end being fixed to the washer 511*b*.

Transversely with respect to the shaft 520 and in a position contained in the axial dimension of the bush 513 there is formed a seat 512*b* in which a first pin 515*a* is accommodated.

On the shaft 502 and below the first pin 515*a* there is also arranged a second pin 515*b* perpendicular to the first pin and inserted in an inclined recess 516 forming a cam formed on the bush 513.

Opposite the external surface of the circular lip 513*a* of the bush 513 there is also arranged a proximity sensor 517 fixed to the support 101 by means of an adjustable flange 517*a*.

The screw 201 operating the support 101 is in this case actuated by a servomotor 602 provided with a measuring device 601 and connected to data processing devices in turn connected to the devices 700 (FIG. 9*b*) for detecting the position of the printing screen 4*a* described below.

The devices 700 (FIG. 9*b*) for detecting and controlling relative centering of glass 2 and printing screen 4*a* comprise two telecameras 701 inserted in corresponding holes 701*a* of the surface 3 and the lens of which, if necessary illuminated by a corresponding light source 702 arranged above the printing frame 4, is able to detect the image of a reference point 4*b* suitably positioned on the printing screen 4*a*, transforming the optical signal into a corresponding digital electrical signal, to be sent to an electronic device 703 for processing the data in turn able to send command signals to the motors 602 for actuating the respective screws 201.

Operation of the automatic centring device is as follows:

Once the silk-screen printing machine has been prepared and the printing frame 4 positioned in its seat, the telecameras 701 detect any misalignment of the reference points 4*b* of the screen 4*a* with respect to the ideal vertical axis of alignment between telecamera and reference point 4*b* and, on the basis of the optical signal representing the misalignment, send corresponding electrical signals to the unit 703 controlling the actuating operations so that the unit is able to calculate the correction to be made to the final position of the sheet. Thus the latter is displaced with respect to the fixed reference points of the machine (telecameras) by the same amount with which the frame 4 is displaced, thus resulting in positioning of the sheet 2 centred with respect to the screen 4*a* whatever the displacement of the latter with respect to the fixed reference points and whatever the shape and the entry position of the sheet onto the working surface 3.

Therefore, when the sheet enters onto the working surface, sensors cause activation of the devices for centring the glass 2 with respect to the printing screen 4*a*: more particularly, the gearmotor 501 is activated, such that it causes rotation of the drive shaft 502 (FIGS. 8*a*, 8*b*, 7) causing movement, by means of the second pin 515*b* and the spring 514, of the bush 513 which, in turn, causes rotation of the driven shaft 520. The latter in turn rotates the pulley 103*a* which moves the toothed belt to which the carriage units 102 are attached, the latter moving symmetrically towards one another until the rollers 102*b* come into contact with the respective edges of the sheet 2 against which they start to press.

This pressure causes stoppage of the toothed belt 103 and hence the motor-driven pulley 103*a* and the driven shaft 520, while the drive shaft 502 continues to rotate causing sliding of the pin 515*b* on the inclined cam 516 of the bush 513 with subsequent axial raising of the bush itself and hence translation of its lip above the proximity sensor 517 which sends a stop signal to the gearmotor 501.

From this point on, the rollers are kept in the closed condition by the spring 514, calibration of which may be predefined by means of adjustment of the base 511.

Below closing of the rollers 102*b*, the telecameras 701 detect the position of the reference marks 4*b* arranged on the screen 4*a* with respect to the fixed reference points (telecameras), calculating the misalignment thereof with respect to the telecameras themselves which send suitable signals to the control unit 703; the latter activates the motor 602 for operation of the respective screw 201 which causes displacement of the support 101 so that stoppage of the rollers 102 gripping the glass is performed in relative positions such as to cause centering of the glass 2 with the printing screen 4*a*.

It must also be emphasized how the centering apparatus according to the invention also allows detection and compensation, during printing, of any displacements from the initial position of the reference points 4*b* of the screen 4*a* due to the elastic deformation of the latter, thus minimising the idle time and production rejects due to this cause.

I claim:

1. A screen printing machine comprising:

a frame including at least two pairs of spaced apart uprights and a pair of spaced apart elongated opposite beams spaced symmetrically apart from and parallel to a longitudinal center axis of the frame and each bridging the respective pair of the uprights;

a support surface mounted between said pairs of uprights below said opposite beams and receiving a flat article to be processed;

delivering means for sequentially loading the flat articles on said support surface perpendicular to said center axis;

a printing screen mounted fixed on said frame above the flat article to be processed;

printing means mounted slidable above said printing screen on said opposite beams for processing each flat article;

displaceable blocking means for gripping a periphery of the flat article to be processed;

a plurality of actuating means for symmetrically closing the blocking means against said periphery of the flat article to center the latter relative to the blocking means, said flat article being displaceably fixed with the blocking means upon gripping; and a plurality of registering means operatively connected with the respective actuating means for displacing the latter along with the flat article in a predetermined position with respect to the printing screen.

2. The machine defined in claim 1 wherein the support surface is formed with a plurality of longitudinal horizontal slots each receiving the blocking means, the latter including a plurality of pairs of gripping elements, each pair of gripping elements being actuated by a respective one of the actuating means which comprises a respective elongated support mounted under said support surface and operatively connected with the respective registering means, a respective plurality of spaced apart sliding shoes mounted slidably on the support and extending upwardly therefrom toward the support surface, a respective pair of carriage units between said sliding shoes and mounted displaceably on the support and connected with a respective one of the pair of gripping elements, respective motor means for actuating one of the carriage units, and respective transmission means for translating movement of said one carriage unit to the other carriage unit, so that said units are displaceable along the support synchronously and in opposite directions thereby bringing the respective pair of the gripping elements toward and away from each other.

3. The machine defined in claim 2 wherein each of the supports includes at east a pair of longitudinal and spaced apart guides, each transmission means including a respective toothed belt which is spaced between the pair of the carriage units and connected therewith and forms an endless loop on a respective pair of pulleys mounted pivotally at opposite ends of the each support.

4. The machine defined in claim 2 wherein each motor means includes a respective pneumatic cylinder extending parallel to the respective support.

5. The machine defined in claim 2 wherein each motor means includes a respective gear motor, a respective driver shaft actuated by said gear motor and extending along a motor axis perpendicular to the respective support, a respective driven shaft coaxial with the driver shaft and operatively connected with the respective transmission means, and a respective torque-limiting coupling between driven and drive shaft.

6. The machine defined in claim 5 wherein each torque-limiting coupling includes a respective bush coaxial with the driver shaft and formed with a radially extending upper end lip, respective cam means for axially displacing the bush upon rotation of the drive shaft, and respective sensor means operatively connected with the end lip for interrupting the upward axial movement of the bush upon reaching a predetermined axial position.

7. The machine defined in claim 6 wherein each cam means includes a respective groove formed inside the bush and extending angularly with respect to the motor axis and receiving a respective pin.

8. The machine defined in claim 2 wherein each registering means includes a respective screw extending parallel to the support of the respective actuating means and under the printing screen, and screw actuating means for actuating the screw to displace the latter upon completing the gripping of the flat article to be processed on the support surface by the respective blocking means.

9. The machine defined in claim 8 wherein screw actuating means includes a handwheel for manual action of the respective screw.

10. The machine defined in claim 8 wherein said registering means further includes a respective display means for digitally illustrating the relative displacement of the support upon actuating of the respective screw.

11. The machine defined in claim 8 wherein the screw actuating means includes control means for automatically detecting a position of reference points formed on the printing screen and a position of the flat article to be processed on the support surface with respect to said reference points, and a servomotor operatively connected with said control means and automatically actuated to place said flat article in the centered position with respect to said printing screen.

12. The machine defined in claim 11 wherein said control means includes a plurality of telecameras each mounted fixed on the support surface and illuminated by a respective light source from above and operatively connected with the control means.

* * * * *